US007406743B2

(12) United States Patent
Kim et al.

(10) Patent No.: US 7,406,743 B2
(45) Date of Patent: Aug. 5, 2008

(54) HANDLE UNIT FOR VACUUM CLEANER

(75) Inventors: Tae-Gwang Kim, Incheon (KR); Jeong-Hee Cho, Jellabuk-Do (KR)

(73) Assignee: Samsung Gwangju Electronics Co., Ltd.

( * ) Notice: Subject to any disclaimer, the term of this patent is extended or adjusted under 35 U.S.C. 154(b) by 60 days.

(21) Appl. No.: 11/494,222

(22) Filed: Jul. 27, 2006

(65) Prior Publication Data

US 2007/0169306 A1 Jul. 26, 2007

(30) Foreign Application Priority Data

Jan. 20, 2006 (KR) ..... 10-2006-0006408

(51) Int. Cl.
*A47L 9/32* (2006.01)
*A47L 9/26* (2006.01)

(52) U.S. Cl. ..... 15/410; 15/323

(58) Field of Classification Search ..... 15/410, 15/414, 323

See application file for complete search history.

(56) References Cited

U.S. PATENT DOCUMENTS 4,545,089 A * 10/1985 Oxel ..... 15/323
4,573,234 A * 3/1986 Kochte et al. ..... 15/323
5,303,447 A * 4/1994 McKnight ..... 15/323
6,564,423 B2 * 5/2003 Sergyeyenko et al. ..... 15/410
6,568,025 B2 * 5/2003 Waldron et al. ..... 15/323
2002/0083550 A1 * 7/2002 Yang ..... 15/323
2005/0268426 A1 * 12/2005 Lee et al. ..... 15/323
2006/0137128 A1 * 6/2006 Elsworthy et al. ..... 15/323
2006/0254019 A1 * 11/2006 Park ..... 15/323

FOREIGN PATENT DOCUMENTS

EP 0316528 9/1988
EP 1512361 3/2004
KR 1997-0057925 11/1997

OTHER PUBLICATIONS

Combined Search and Examination Report dated Nov. 22, 2006 issued by the British Patent Office with respect to the British Application No. GB0616760.5.
Office Action dated Dec. 11, 2006 issued from the Korean Intellectual Property Office with respect to Korean Patent Application No. 2006-6408 filed on Jan. 20, 2006.

* cited by examiner

*Primary Examiner*—David B Thomas
(74) *Attorney, Agent, or Firm*—Ohlandt, Greeley, Ruggiero & Perle, LLP.

(57) ABSTRACT

The present disclosure relates to a handle unit for a vacuum cleaner. The handle unit for the vacuum cleaner for controlling a cleaner body of the vacuum cleaner includes a handle body of the vacuum cleaner; and a supporting unit projected from one side of the handle body, the supporting unit holding an accessory brush, wherein the supporting unit and the handle body is molded in a single piece by the injection molding process.

18 Claims, 4 Drawing Sheets

HANDLE UNIT FOR VACUUM CLEANER

CROSS-REFERENCE TO RELATED APPLICATIONS

This application claims the benefit under 35 U.S.C. § 119 (a) from Korean Patent Application No. 2006-0006408 filed Jan. 20, 2006 in the Korean Intellectual Property Office, the disclosure of which is incorporated herein by reference in its entirety.

BACKGROUND OF THE INVENTION

1. Field of the Invention

The present disclosure relates to a handle unit for a vacuum cleaner. More particularly, the present disclosure relates to a handle unit for a vacuum cleaner having a supporting structure for accessories such as accessory brushes.

2. Description of the Related Art

Generally, an upright vacuum cleaner includes a suction brush assembly facing a surface to be cleaned, a cleaner body disposed at a top end of the suction brush assembly, and a handle unit disposed at a top end of the cleaner body for users to control the upright vacuum cleaner.

A motor chamber and a dust collecting chamber are formed inside the cleaner body. A driving motor for generating suction force is disposed in the motor chamber. The motor chamber is in fluid communication with the dust collecting chamber. The dust collecting chamber has a filtering member for filtering contaminants contained in air drawn in via the suction brush assembly. Any one of cyclone dust collectors and dust bags can be used as the filtering member. The dust collecting chamber is in fluid communication with the suction brush assembly via a connecting hose. Therefore, the suction force of the driving motor is transmitted to the suction brush assembly via the dust collecting chamber and the connecting hose. An end of the connecting hose is attachably/detachably disposed at the suction brush assembly. Therefore, when cleaning any one of corners, edges, and places located at a height higher than the floor, users can separate the connecting hose from the suction brush assembly so as to clean them using the connecting hose.

Furthermore, separate accessories, such as a mini-turbine brush for the cleaning of special materials, for example, a carpet or blanket, a crevice cleaning tool, and so on can be attached to the connecting hose. Manufacturers of the upright type vacuum cleaners usually offer or sell these separate accessories.

However, the accessories are usually kept in storage in an unspecific place without connecting to the connecting hose so that it is inconvenient to store the accessories. Accordingly, users experience inconvenience when having to search for the specific accessory stored separately for an application and when needing to connect the specific accessory to the connecting hose.

To solve the problem, Korean Patent Publication No. 2001-0106671 discloses an accessory fixing apparatus comprising a separate supporting member disposed on a rear side of the cleaner body for fixing an accessory brush therein. However, because the connecting hose is usually connected to the rear side of the cleaner body, a problem arises in that the connecting hose is interfered with the accessory fixing apparatus. As a result, users experience inconvenience when using the connecting hose.

To solve the above problems, this applicant has filed the application with respect to a vacuum cleaner, namely, Korean Patent Publication No. 2005-0116081. The vacuum cleaner has a supporting bracket disposed on the handle unit and for an accessory brush to be detachably mounted in the supporting bracket so that the connecting hose is not interfered with the supporting bracket and the accessory brush can easily be connected with or separated from the connecting hose during cleaning work. To store the accessory brush in the handle unit certainly provides users with the convenience of use. However, the vacuum cleaner produces a side effect in that manufacturing cost is increased because the supporting bracket is separately manufactured and assembled at the handle unit. Furthermore, the handle unit usually includes a front and rear handle covers separately formed and assembled each other so that the manufacturing process of the handle unit is complex.

SUMMARY OF THE INVENTION

The present disclosure has been developed in order to overcome the above drawbacks and other problems associated with the conventional arrangement. An aspect of the present disclosure is to provide a handle unit for a vacuum cleaner employing an accessory supporting structure that can cause users to easily store and use accessories such as an accessory brush at the handle unit, and has an improved structure.

The above aspect and/or other features of the present disclosure can substantially be achieved by providing a handle unit for a vacuum cleaner for users to control a cleaner body of the vacuum cleaner. The handle unit for the vacuum cleaner includes a handle body of the vacuum cleaner; and a supporting unit projected from one side of the handle body, the supporting unit holding an accessory brush, wherein the supporting unit and the handle body is molded in a single piece by the injection molding process. Preferably, the handle body may be molded in a single piece by the injection molding process. Therefore, the handle unit according to the present disclosure has a simpler structure than the conventional handle unit having a front cover, a rear cover, and an accessory brush supporting bracket separately manufactured. As a result, the manufacturing process of the handle unit is shortened so that the manufacturing cost is decreased.

The accessory brush is locked or unlocked in the supporting unit without a separate fixing member. Therefore, users can simply mount the accessory brush to the handle unit or separate the accessory brush from the handle unit, when performing the cleaning work. In other words, users experience convenience when using accessories and when storing the accessories.

The accessory brush is pushed down contacting the supporting unit so as to be locked in the supporting unit, and the accessory brush is pushed up so as to be separated from the supporting unit.

The supporting unit comprises at least two supporting projections projected from a front surface of the handle body. The at least two supporting projections comprises a first and second supporting projections projected in a lengthwise direction of the handle unit, and a third supporting projection projected in a widthwise direction of the handle unit, the first and second supporting projections connected with two catching projections of the accessory brush, and the third supporting projection pressing the accessory brush to be locked to the handle unit.

With the handle unit for the vacuum cleaner according to an embodiment of the present disclosure, because the supporting unit is projected from the front surface of the handle unit, the handle unit has a simple structure, and the handle body and the supporting unit can be molded in a single body by the injection molding process. As a result, the manufacturing and assembling process of the handle unit is shortened, the manufacturing cost of the vacuum cleaner is decreased.

Also, because the accessory brush is simply mounted to/separated from the projected supporting unit, users can easily use the accessory brush.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiment of the present disclosure will be described in detail with reference to the accompanying drawings.

The matters defined in the description, such as a detailed construction and elements thereof, are provided to assist in a comprehensive understanding of the disclosure. Thus, it is apparent that the present disclosure may be carried out without those defined matters. Also, well-known functions or constructions are omitted to provide a clear and concise description of exemplary embodiments of the present disclosure.

Figure 1:
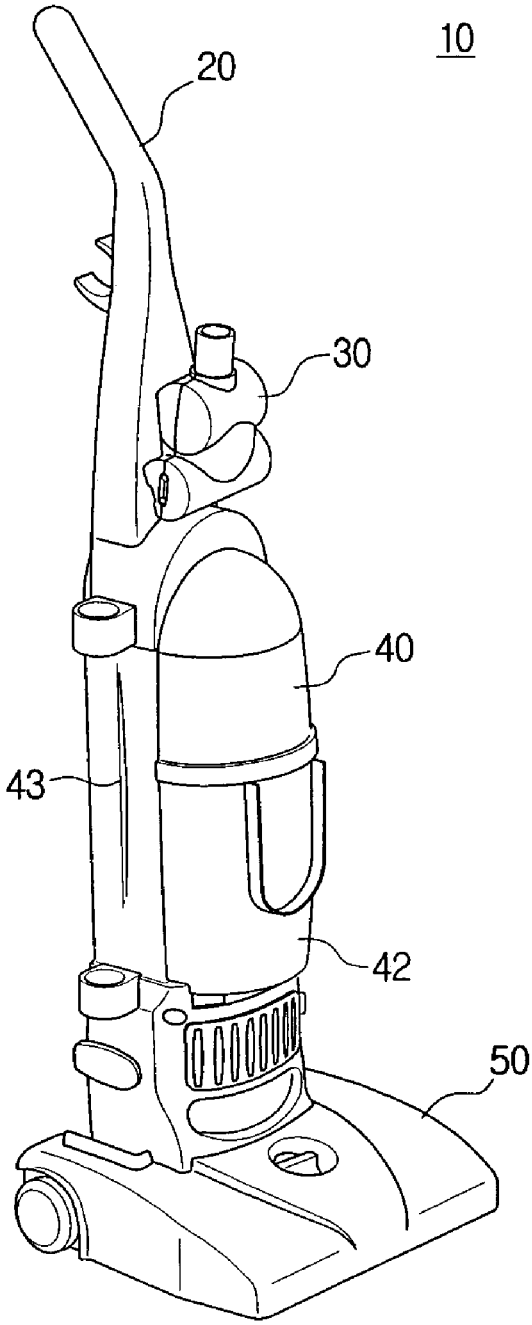
FIG. 1 is a perspective view illustrating an upright vacuum cleaner employing a handle unit according to an embodiment of the present disclosure.

FIG. 1 is a perspective view illustrating an upright vacuum cleaner 10 employing a handle unit 20 according to an embodiment of the present disclosure.

Referring to FIG. 1, the upright vacuum cleaner 10 includes a cleaner body 40, a suction brush assembly 50, and a handle unit 20.

The cleaner body 40 includes a driving source (not shown) generating a suction force, a dust collector 42 collecting dust contained in the air drawn in, and a body frame 43 supporting them. The driving source is disposed under the dust collector 42, and the body frame 43 supports the driving source and the dust collector.

The suction brush assembly 50 is connected with a bottom end of the cleaner body 40, and has, at a bottom surface thereof, a suction port (not shown) that faces a surface to be cleaned and draws in dust or contaminants from the surface to be cleaned. The suction brush assembly 50 is connected to the cleaner body 40 with a hinge connection so that, when performing the cleaning work, the cleaner body 40 is inclined with respect to the suction brush assembly 50, and when storing, the cleaner body 40 is returned in the vertical posture as shown in FIG. 1.

Figure 2:
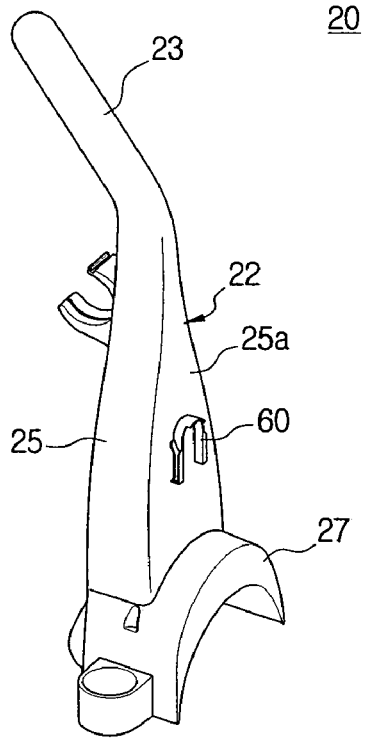
FIG. 2 is a perspective view illustrating a handle unit for a vacuum cleaner according to an embodiment of the present disclosure.

Referring to FIG. 2, the handle unit 20 includes a handle body 22 formed as a single peace, and a supporting unit 60 is integrally formed with the handle body 22 on a front surface 25*a* of the handle body 22. The supporting unit 60 projects from the handle body 22 so as to be integrally molded with the handle body 22 by the injection molding process. As a result, the handle unit 20 having the handle body 22 and the supporting unit 60 can be molded by one injection molding process.

The handle body 22 has a handle part 23 for users to grip, a body part 25 for the supporting unit 60 to be disposed at, and a connecting part 27 connected with the cleaner body 40 (see FIG. 1). The connecting part 27 is connected with a top end of the cleaner body 40 using a connecting member (not shown). When performing the cleaning work, users grip the handle part 23 so as to angle the cleaner body 40 with respect to the suction brush assembly 50, and move the cleaner body 40 and suction brush assembly 50 in any direction. The body part 25 is formed in a shape expanded from the width of the handle part 23 to the width of the connecting part 27 so as to connect the handle part 23 with the connecting part 27. The connecting part 27 has the substantially same width as the width of the top end of the cleaner body 40.

Figure 3:
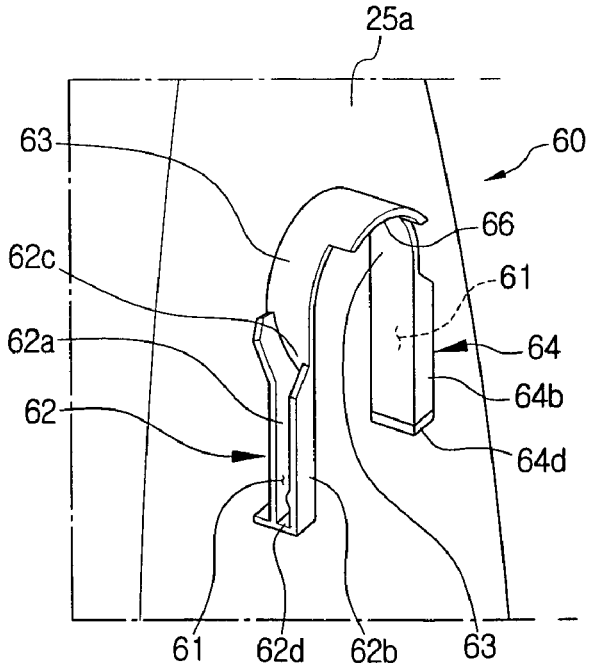
FIG. 3 is an enlarged perspective view illustrating a supporting unit of the handle unit of FIG. 2.

Referring to FIG. 3, the supporting unit 60 includes a first supporting projection 62, a second supporting projection 64, and a third supporting projection 66. The first and second supporting projections 62 and 64 are disposed on the front of the body part 25 substantially parallel with each other from the handle part 23 to the connecting part 27, namely, from an upper side to an under side of the upright vacuum cleaner 10 vertically standing as shown in FIG. 1. The height of the first supporting projection 62 is the substantially same as the height of the second supporting projection 64. The third supporting projection 66 is disposed at an approximate center between top ends of the first and second supporting projections 62 and 64 substantially perpendicular to the first and second supporting projections 62 and 64, namely, substantially horizontal to the floor.

A connecting plate 63 connects all the first, second, and third supporting projections 62, 64, and 66. Referring to FIG. 3, each of the first and second supporting projections 62 and 64 is formed in a substantially straight duct shape having an inner space 61 with one opened face and three closed faces. The first supporting projection 62 has a first, second, and third guiding plates 62*a*, 62*b*, and 62*c*, and a supporting stopper 62*d*. The second supporting projection 64 is formed in a symmetrical shape with respect to the first supporting projection 62, and has the same elements. Therefore, the first supporting projection 62 alone will be described for conciseness. The first guiding plate 62*a* is attached on the front surface of the handle body 22, and the second guiding plate 62*b* is spaced apart from the first guiding plate 62*a* parallel to the first guiding plate 62*a*. The third guiding plate 62*c* is disposed between side ends of the first and second guiding plates 62*a* and 62*b* so that the third guiding plate 62*c* connects the first guiding plate 62*a* with the second guiding plate 62*b*. Also, the third guiding plate 62*c* is connected to the connecting plate 63. The supporting stopper 62*d* is disposed at bottom ends of the first, second, and third guiding plates 62*a*, 62*b*, and 62*c* so that the supporting stopper 62*d* supports a bottom housing 34 (see FIG. 4*a*) of an accessory brush 30 being downwardly guided through the inner space 61 of the first supporting projection 62. The height of the third supporting projection 66 is higher than the height of each of the first and second supporting projections 62 and 64 so that the third supporting projection 66 pushes the accessory brush 30 in a direction opposite to the handle body 22. As a result, the accessory brush 30 is not moved in the supporting unit 60. In this embodiment, all elements of the first, second, and third supporting projections 62, 64, and 66 are integrally molded with the handle body 22 by the injection molding process. Therefore, the manufacture of the handle body 22 and the supporting unit 60 is completed by one injection molding process.

Figure 4A:
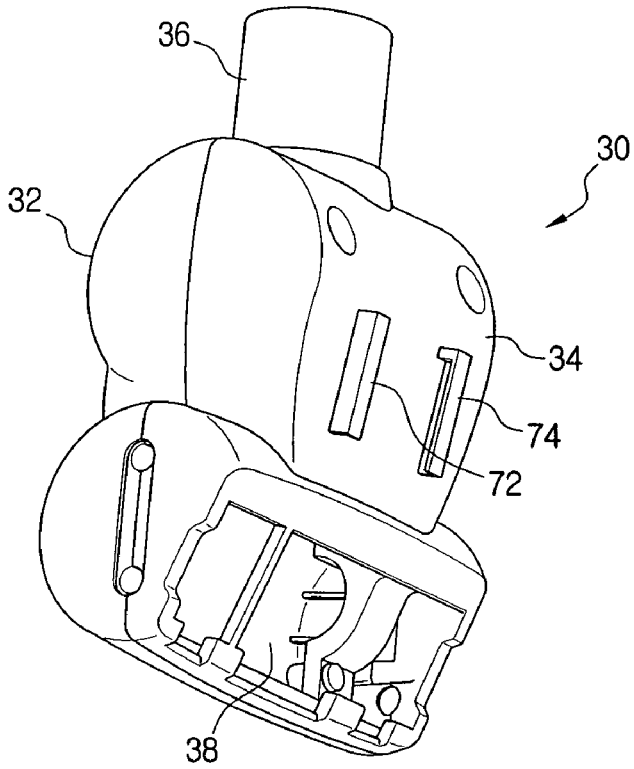
FIG. 4*a* is a perspective view illustrating an example of an accessory brush detachably mounted at the handle unit of FIG. 2.
Figure 4B:
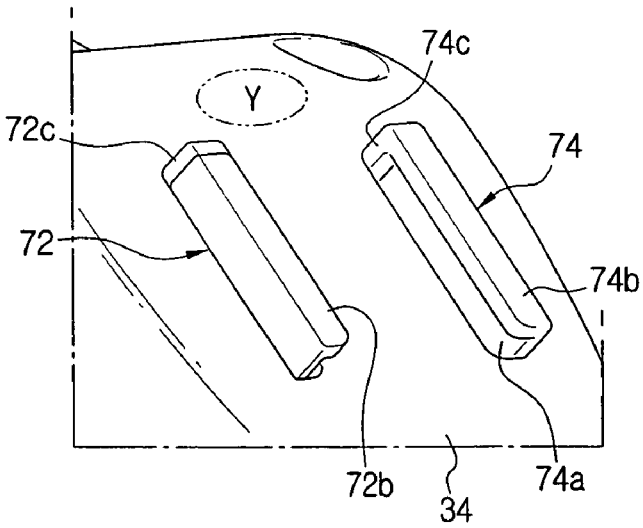
FIG. 4*b* is a partially enlarged perspective view illustrating a bottom housing of the accessory brush of FIG. 4*a*.

Referring to FIGS. 4*a* and 4*b*, the accessory brush 30 includes a suction port 38, an upper housing 32, a bottom housing 34, and a connecting pipe 36 like general suction brushes. Especially, the accessory brush 30 according to this embodiment has a first and second catching projection 72 and 74 so as to be coupled with the supporting unit 60. The first and second catching projections 72 and 74 project from the bottom housing 34 parallel with each other and have a symmetrical structure. Because the first and second catching projections 72 and 74 have the same elements, the second catching projection 74 alone will be described for conciseness. The second catching projection 74 has a first and second plate 74*a* and 74*b*, and a catching stopper 74*c*. The first plate 74*a* is disposed at the bottom housing 34, and a wide side of the first plate 74*a* is perpendicular to the bottom housing 34. The second plate 74*b* is connected to the first plate 74*a*, and a wide side of the second plate 74*b* is opposite the bottom housing 34. The catching stopper 74*c* is disposed at top ends of the first and second plates 74*a* and 74*b* so that, when the second catching projection 74 is completely inserted into the inner space 61 of the supporting unit 60, the catching stopper 74*c* is touched to a top end of the second guiding plate 64*b* of the second supporting projection 64. At this time, the catching stopper 72*c* of the first catching projection 72 is touched to a top end of the second guiding plate 62*b* of the first supporting projection 62. Also, the second plate 74*b* of the second catching projection 74 is touched to the supporting stopper 64*d* of the second supporting projection 64, and the second plate 72*b* of the first catching projection 72 is touched to the supporting stopper 62*d* of the first supporting projection 62. Furthermore, the third supporting projection 66 presses the area Y of the bottom housing 34 encircled in FIG. 4*b* so as to push the accessory brush 30 in a direction opposite to the handle body 22. As a result, the accessory brush 30 may not be moved in the handle body 22. This embodiment as described above shows only one example of structures in that the handle unit and the supporting unit can be integrally molded by the injection molding process. In fact, as long as the handle unit with the supporting unit can be molded as a single piece by the injection molding process, and the accessory brush can be locked and unlocked in the supporting unit without a separate fixing member, there are various structures of the supporting unit and the accessory brush.

Hereinafter, operation of the handle unit for the vacuum cleaner according to an embodiment of the present disclosure as described above will be explained with reference to FIG. 5.

Figure 5:
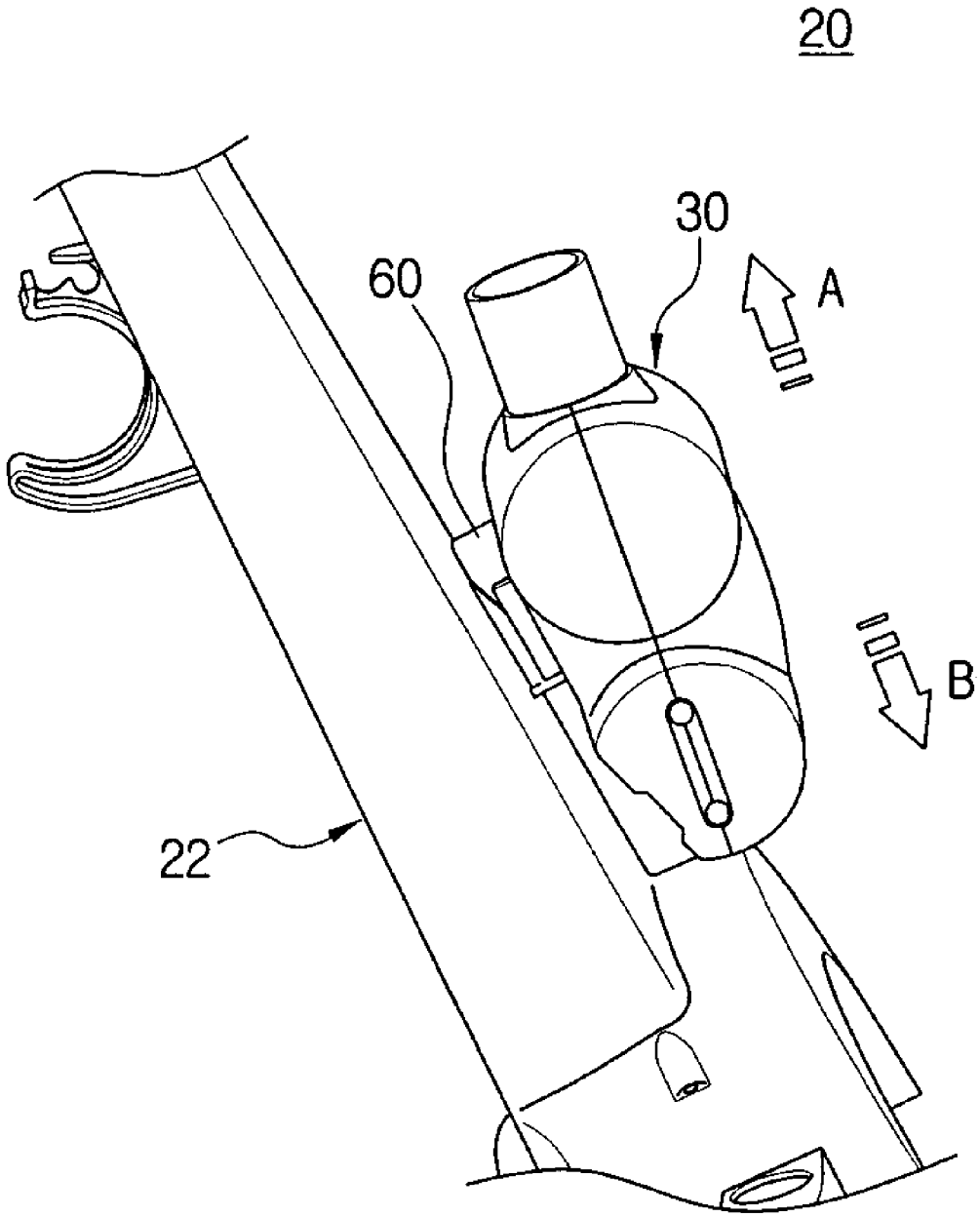
FIG. 5 is a partially perspective view illustrating the accessory brush of FIG. 4*a* mounted at the handle unit of FIG. 2.

As shown in FIG. 5, while touching the first and second catching projections 72 and 74 of the accessory brush 30 to the supporting unit 60, which is integrally molded with the handle body 22 and projects from the front surface of the handle body 22, users move the accessory brush 30 downwardly as illustrated by arrow B in FIG. 5 so that the accessory brush 30 is locked in the supporting unit 60. Then, when the accessory brush 30 is moved in a direction of arrow A in FIG. 5, the accessory brush 30 is separated from the supporting unit 60.

The above process is described in detail with reference to FIGS. 3 and 4*b*. The users insert an end of the second plate 72*b* and 74*b* of each of the first and second catching projections 72 and 74 into the inner space 61 of each of the first and second supporting projections 62 and 64, and then move the accessory brush 30 down in a direction of arrow B of FIG. 5 so that the second plates 72*b* and 74*b* are completely inserted into the inner spaces 61. As a result, the second plates 72*b* and 74*b* are caught by each supporting stopper 62*d* and 64*d* of the first and second supporting projections 62 and 64, and each catching stopper 72*c* and 74*c* of the first and second catching projections 72 and 74 touch the top ends of the second guiding plates 62*b* and 64*b* so that the accessory brush 30 can not be moved. Furthermore, because the third supporting projection 66 projects further than the first and second supporting projections 62 and 64, the third supporting projection 66 pushes the bottom housing 34 of the accessory brush 30 in a direction opposite to the handle body 22 so as to lock the accessory brush 30 further, thereby preventing the accessory brush 30 from moving.

When users want to use the accessory brush 30 during cleaning work, the users simply push the accessory brush 30 up in a direction of arrow A of FIG. 5 so that the accessory brush 30 is separated from the handle unit 20. After using the accessory brush 30, the users simply push the accessory brush 30 down in a direction of arrow B of FIG. 5.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A handle unit for a vacuum cleaner for controlling a cleaner body of the vacuum cleaner, the handle unit comprising:

a handle body of the vacuum cleaner; and a supporting unit projecting from one side of the handle body, the supporting unit being adapted to hold an accessory brush, wherein the supporting unit and the handle body are molded in a single piece by the injection molding process, wherein the supporting unit comprises at least two supporting projections projected from a front surface of the handle body, and wherein the at least two supporting projections comprises first and second supporting projections projected in a lengthwise direction of the handle unit, and a third supporting projection projected in a widthwise direction of the handle unit, the first and second supporting projections connected with two catching projections of the accessory brush, and the third supporting projection pressing the accessory brush in a direction opposite to the handle body to bring the first and second supporting projections and the two catching projections in friction contact to one another and thereby locking the accessory brush to the handle unit.

2. The handle unit of claim 1, wherein the handle body is molded in a single piece by the injection molding process.

3. The handle unit of claim 1, wherein the accessory brush is locked or unlocked in the supporting unit without a separate fixing member.

4. The handle unit of claim 3, wherein the accessory brush is pushed down contacting the supporting unit so as to be locked in the supporting unit, wherein the accessory brush is pushed up so as to be separated from the supporting unit.

5. A handle unit for a vacuum cleaner, comprising:

a handle body; and a supporting unit integrally formed with and projecting from the handle body, the supporting unit having first and second supporting projections projecting in a lengthwise direction of the handle unit and a third supporting projection projecting in a widthwise direction of the handle unit, wherein the first and second supporting projections are configured to selectively connect with an accessory brush, and wherein the third supporting projection projects further from the handle body than the first and second supporting projections so that the third supporting projection can push the accessory brush in a direction opposite to the handle body to bring the first and second supporting projections and the accessory brush in friction contact to one another so as to lock the accessory brush to the handle body without a separate fixing member.

6. The handle unit of claim 5, wherein the supporting unit is configured such that the accessory brush can be locked to the handle body by pushing the accessory brush downward and such that the accessory brush can be unlocked from the handle body by pushing the accessory brush upward.

7. The handle unit of claim 5, wherein the first and second supporting projections are substantially parallel with each other.

8. The handle unit of claim 5, wherein the first and second supporting projections project from the handle body to substantially the same height.

9. The handle unit of claim 5, wherein the third supporting projection is disposed at an approximate center between top ends of the first and second supporting projections and is disposed substantially perpendicular to the first and second supporting projections.

10. The handle unit of claim 5, wherein the first and second supporting projections are formed in a substantially straight duct shape having an inner space with one opened face and three closed faces.

11. The handle unit of claim 5, further comprising a connecting plate connecting the first, second, and third supporting projections.

12. The handle unit of claim 11, wherein the first and second supporting projections each comprise a first guiding plate, a second guiding plate, and a third guiding plate, wherein the first guiding plate depends from the front surface of the handle body, the second guiding plate is spaced apart from the first guiding plate and parallel to the first guiding plate, the third guiding plate is disposed between side ends of the first and second guiding plates so that the third guiding plate connects the first and second guiding plates, and wherein the third guiding plate is connected to the connecting plate.

13. A vacuum cleaner comprising:

an accessory brush having first and second catching projections projecting from a bottom surface parallel with and symmetrical to each other;

a handle body; and a supporting unit integrally formed with and projecting from the handle body the supporting unit selectively securing the accessory brush to the handle body, the supporting unit having first and second supporting projections projecting in a lengthwise direction of the handle unit and substantially parallel with each other and a third supporting projection projecting in a widthwise direction of the handle unit, wherein the first and second supporting projections are configured to selectively connect with the first and second catching projections of the accessory brush, respectively, and wherein the third supporting projection projects further from the handle body than the first and second supporting projections so that the third supporting projection can push the accessory brush in a direction opposite to the handle body to bring the first and second supporting projections and the first and second catching projections in friction contact to one another so as to lock the accessory brush to the handle body without a separate fixing member.

14. The vacuum cleaner of claim 13, wherein the supporting unit is configured such that the accessory brush can be locked to the handle body by pushing the accessory brush downward and such that the accessory brush can be unlocked from the handle body by pushing the accessory brush upward.

15. The vacuum cleaner of claim 13, wherein the first and second supporting projections project from the handle body to substantially the same height.

16. The vacuum cleaner of claim 13, wherein the first and second supporting projections are formed in a substantially straight duct shape having an inner space with one opened face and three closed faces.

17. The handle unit of claim 13, further comprising a connecting plate connecting the first, second, and third supporting projections.

18. The handle unit of claim 17, wherein the first and second supporting projections each comprise a first guiding plate, a second guiding plate, and a third guiding plate, wherein the first guiding plate depends from the front surface of the handle body, the second guiding plate is spaced apart from the first guiding plate and parallel to the first guiding plate, the third guiding plate is disposed between side ends of the first and second guiding plates so that the third guiding plate connects the first and second guiding plates, and wherein the third guiding plate is connected to the connecting plate.

* * * * *